US008277121B2

(12) United States Patent
Bell et al.

(10) Patent No.: US 8,277,121 B2
(45) Date of Patent: Oct. 2, 2012

(54) BAG CONSTRUCTION WITH FLAT BOTTOM HAVING REMOVABLE LAYER

(75) Inventors: Gary Michael Bell, Crystal, MN (US); Hiroyuki Takigawa, Chiba-ken (JP)

(73) Assignee: Ampac Holdings LLC, Cincinnati, OH (US)

( * ) Notice: Subject to any disclaimer, the term of this patent is extended or adjusted under 35 U.S.C. 154(b) by 219 days.

(21) Appl. No.: 12/570,687

(22) Filed: Sep. 30, 2009

(65) Prior Publication Data

US 2010/0084425 A1 Apr. 8, 2010

Related U.S. Application Data

(63) Continuation-in-part of application No. 11/731,754, filed on Mar. 30, 2007, now abandoned.

(51) Int. Cl.

| | |
|---|---|
| ***B65D 33/00*** | (2006.01) |
| ***B65D 33/16*** | (2006.01) |
| ***B65D 33/30*** | (2006.01) |
| ***B65D 30/20*** | (2006.01) |

(52) U.S. Cl. ..... 383/210; 383/67; 383/89; 383/120; 383/906

(58) Field of Classification Search ..... 383/210, 383/211, 67, 120, 104, 62, 78, 82, 88, 89, 383/90, 906

See application file for complete search history.

(56) References Cited

U.S. PATENT DOCUMENTS

| | | | | | |
|---|---|---|---|---|---|
| 2,325,942 | A | * | 8/1943 | Drake | 222/107 |
| 2,332,768 | A | * | 10/1943 | Wilcox | 222/565 |
| 3,159,096 | A | * | 12/1964 | Tocker | 100/211 |
| 3,229,813 | A | | 1/1966 | Crowe, Jr. et al. | |
| 3,258,169 | A | * | 6/1966 | Paisley | 222/107 |
| 3,369,709 | A | | 2/1968 | Clauss | |
| 3,567,074 | A | | 3/1971 | Brown | |
| 4,486,187 | A | * | 12/1984 | Foster | 493/194 |
| 4,576,316 | A | | 3/1986 | Foster | |
| 4,584,201 | A | | 4/1986 | Boston | |
| 4,936,456 | A | | 6/1990 | Bell et al. | |
| 4,986,673 | A | | 1/1991 | Bell | |
| 5,059,036 | A | | 10/1991 | Richison et al. | |
| 5,147,272 | A | | 9/1992 | Richison et al. | |
| 5,254,073 | A | | 10/1993 | Richison et al. | |
| 5,617,974 | A | * | 4/1997 | Sawyer, Jr. | 222/107 |
| 5,709,479 | A | | 1/1998 | Bell | |
| 5,785,428 | A | * | 7/1998 | Mazzocchi | 383/103 |
| 5,882,120 | A | | 3/1999 | Bell | |
| 5,971,613 | A | | 10/1999 | Bell | |
| 6,126,318 | A | | 10/2000 | Bell | |
| 6,213,645 | B1 | | 4/2001 | Beer | |
| 6,254,273 | B1 | * | 7/2001 | Galomb et al. | 383/63 |
| 6,257,763 | B1 | | 7/2001 | Stolmeier et al. | |

(Continued)

FOREIGN PATENT DOCUMENTS

JP 8-276944 A 10/1996

(Continued)

*Primary Examiner* — Jes F Pascua
(74) *Attorney, Agent, or Firm* — Perman & Green, LLP

(57) ABSTRACT

A bag construction filled with dispersible material. The bag construction has first and second panel sections, first and second side gusset sections and a bottom gusset panel section. The various panel sections are fastened together to form a generally rectangle shape with a flat bottom. The bottom gusset panel section has one or more distribution apertures in it. A removable panel layer is provided for covering the one or more apertures. When the removable panel layer is removed, the bag can be held so that the dispersible material disperses through the apertures as appropriate.

14 Claims, 11 Drawing Sheets

U.S. PATENT DOCUMENTS

| | | | |
|---|---|---|---|
| 6,375,037 | B1 | 4/2002 | Bell et al. |
| 6,398,412 | B2 | 6/2002 | Wedi et al. |
| 6,423,356 | B2 | 7/2002 | Richison et al. |
| 2006/0104550 | A1 | 5/2006 | Kuge |
| 2008/0240623 | A1 | 10/2008 | Bell |
| 2008/0240626 | A1 | 10/2008 | Bell |

FOREIGN PATENT DOCUMENTS

| | | | | |
|---|---|---|---|---|
| JP | 2000-310835 | A | | 11/2000 |
| JP | 2005-255201 | A | | 9/2005 |
| JP | 2005-280767 | A | | 10/2005 |
| JP | 2005280767 | A | * | 10/2005 |
| JP | 2006-036367 | A | | 2/2006 |

* cited by examiner

BAG CONSTRUCTION WITH FLAT BOTTOM HAVING REMOVABLE LAYER

CROSS-REFERENCES TO RELATED APPLICATIONS

This is a continuation-in-part application of U.S. Ser. No. 11/731,754, filed Mar. 30, 2007, now abandoned.

FIELD

The description relates to a bag or pouch construction. In particular, the description relates to a bag intended to be filled with dispersible materials, wherein the bag has a flat bottom with apertures therein and a removable layer closing the apertures until use.

BACKGROUND

A wide variety of items comprise materials which, in use, are dispersed or spread over an area. Many of these items include dry powder or particulate materials. The term "dispersible materials" as used herein is intended at least to include pellets, grains, powders, and any combinations thereof. Examples of these include, but are not limited to, icing salts, seeds, insecticides, chalk, etc.

Some improved arrangements for spreading particulate materials have been disclosed, for example, in U.S. Pat. Nos. 5,882,120 and 5,709,479. However, the arrangements have several problems relative to the particular usage disclosed herein.

The prior art bag arrangements are difficult to store and arrange because the bottom portion does not have a design which allows the bags to stand upright. A storage bag which stands upright for product storage and point-of-sale display is desirable because such a bag arrangement provides an easier method of storing and stacking for distributors and retail merchants.

Additionally, the prior art bag arrangements are not easily filled since they have limited expandability along the sides and bottom portion. This results in less volume and amount of material being filled into the bag. Also, the rib-and-trough closure system of prior art bag arrangements is expensive to manufacture and interferes with a bottom arrangement which would allow the bag to stand upright. Furthermore, often particulate materials become stuck inside the trough portions of the closure system. Undesirably, this may cause a lack of a good seal which can lead to leaks and/or contamination of the particulate material therein.

Accordingly, an improvement is sought which would be simpler and yet allow a bag to stand upright, while also providing for dispersability when desired.

SUMMARY

The bag construction of the present description is directed to a bag or pouch for dispersing dispersible material. The bag has first and second panel sections, first and second side gusset panel sections, and a bottom gusset panel section. The various panel sections are fastened together to form a generally rectangular shape with flat bottom. The bottom gusset panel section has one or more distribution apertures in it. A removable panel layer is provided for covering the one or more apertures. The removable panel layer is removably fastened to the outer surface of the bottom gusset panel section.

In an embodiment, the bag construction comprises a peel off layer provided between the bottom gusset panel section and the removable panel layer, the peel off layer being penetrated through by the distribution aperture. The embodiment further comprises the distribution aperture being a flap that has a fixed portion fixed to the bottom gusset panel section. The embodiment further includes the removable layer configured to be removed from the peel off layer in a peeling direction away from the fixed portion.

In another embodiment, the removable panel layer includes a peel off layer provided towards the outer surface of the bottom gusset panel section. In the embodiment, the distribution aperture is a flap that has a fixed portion fixed to the bottom gusset panel section, and the removable layer is configured to be removed from the peel off layer in a peeling direction away from the fixed portion.

In an embodiment, the bottom gusset panel section includes a first bottom layer, a second bottom layer, and a third bottom layer. The first bottom layer is provided towards the inner surface, the third bottom layer is provided towards the outer surface, and the second bottom layer is provided between the first bottom layer and the third bottom layer. The embodiment includes a plurality of distribution apertures provided on the first bottom layer, penetrating through the first bottom layer. The embodiment includes at least one distribution aperture being a flap that has a fixed portion fixed to the first bottom layer. The embodiment includes the third bottom layer being removable from the second bottom layer, wherein when said third bottom layer is fastened in place, said flap is covered closed to prevent dispersing the dispersible material, and when said third bottom layer is removed from said second bottom layer, said dispersible material may be dispersed through opening of said flap. In an embodiment, the third bottom layer is configured to be removed from the second bottom layer in a peeling direction away from the fixed portion of the flap.

When the bag construction is used, the removable panel layer covering the one or more apertures is removed to uncover the one or more apertures. In that way, dispersable material can be dispersed through the one or more apertures.

In a further embodiment, a tape section or other fastening mechanism is provided so that following use of the bag construction where there has been dispersion so that some of the dispersible material has been removed from the bag, the bottom gusset panel is folded or rolled from one of its edges toward the opposite edge so that the apertures are covered. The tape section or other fastening mechanism is then used to fasten one of the panel sections to either the bottom gusset panel section or the other of the panel sections.

In this way, a simple and efficient bag construction is formed which provides for upright display, easy uncovering of apertures in the bottom gusset section so that dispersion can take place and, in a further embodiment, a mechanism for covering the one or more apertures so that the dispersible material can be further stored and used again.

DETAILED DESCRIPTION

Figure 1:
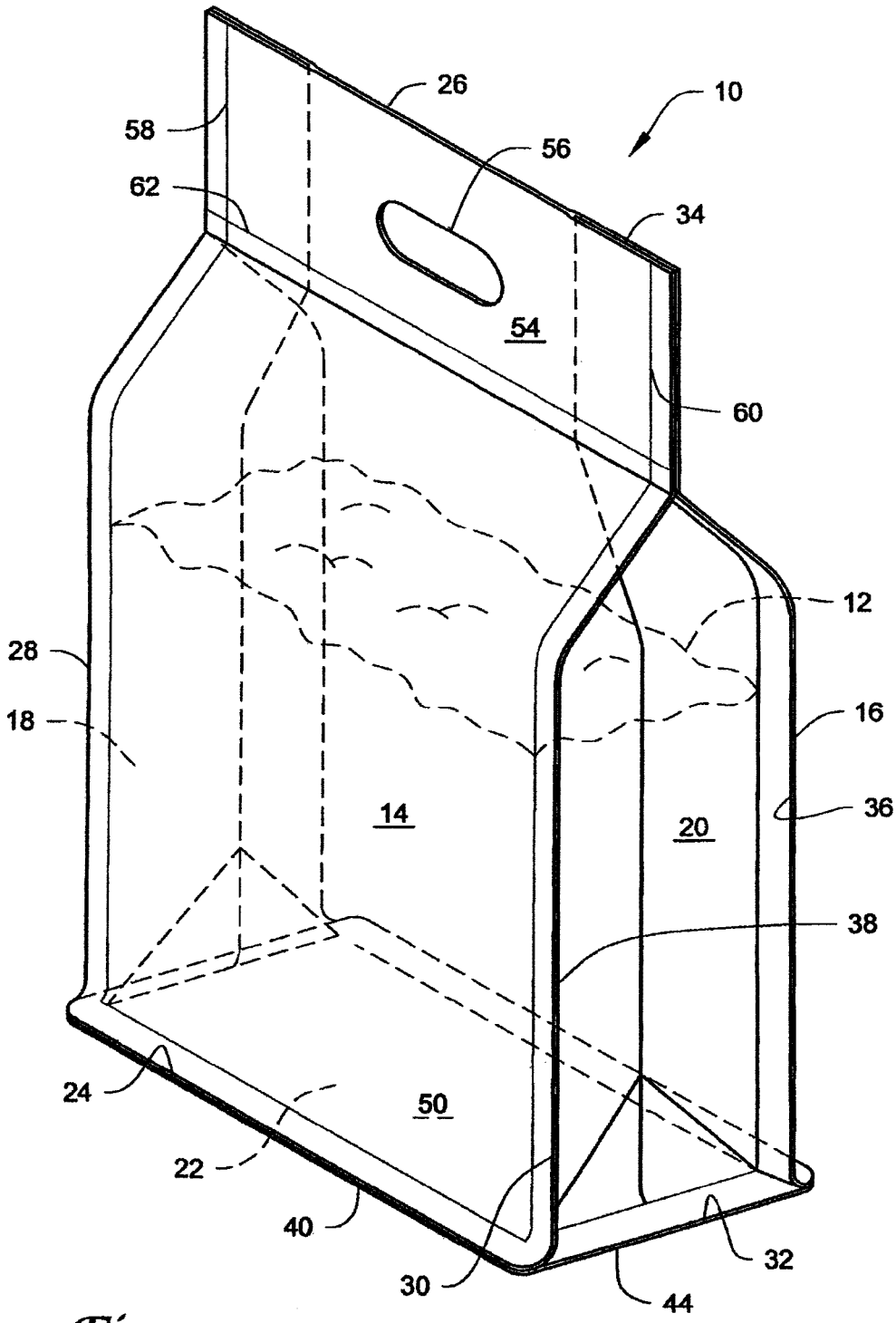
FIG. 1 is a perspective view of a bag construction in accordance with an embodiment.

The present invention is now described relative to the drawings wherein the same numerals are used to designate the same or similar parts throughout the several views and embodiments.

An embodiment of a bag construction is shown in the figures as numeral 10. With reference to FIGS. 1-4, bag construction 10 includes first and second opposing, sidewall, panel sections 14, 16. Bag construction 10 also includes first and second, opposed, side gusset panel sections 18, 20. In addition, bag construction 10 has a bottom gusset panel section 22.

The first and second panel sections 14, 16 each have bottom and top edges 24, 26 and opposite side edges 28, 30. Likewise, first and second side gusset panel sections 18, 20 each have bottom and top edges 32, 34 and opposite side edges 36, 38. Bottom gusset panel section has opposite edges 40, 42, meeting with the edges of the first and second panel sections and opposite edges 44, 46 mating with the edges of the first and second side gusset panel sections 18, 20.

One of the side panel edges of each of the first and second panel sections 14, 16 is fastened to one of the side gusset edges of each of the first and second gusset sections 18, 20. Each of the bottom panel edges of the first and second panel sections 14,16 and bottom gusset edges of the first and second side gusset panel sections 18,20 are fastened to a different one of the edges of the bottom gusset panel section 22 to form inner and outer surfaces 50,52 of the bottom gusset panel section 22.

In areas where the edges are fastened to one another, the fastening mechanism preferably comprises heat sealing. The seals in this regard are conventional, such as those illustrated in U.S. Pat. No. 5,059,036; U.S. Pat. No. 5,147,272; and U.S. Pat. No. 5,254,073, incorporated herein by reference.

Referring again to the figures, bag construction 10 is closed at the top end after filling and then includes an upper flap 54. Upper flap 54 has a handle aperture 56 therein. Before the upper flap 54 is created, dispersable material 12 is filled into bag 10. (Shown in FIG. 2). Once filled, first and second side gusset panel sections 18,20 are appropriately folded between the top end portions of first and second panel sections 14,16. Heat seals are appropriately applied to create the upper flap 54. That is, heat seals are applied at side edges 58,60 and at top location 64 which is approximately an equal distance on the other side of aperture 56 from the top edge 26.

Figure 3:
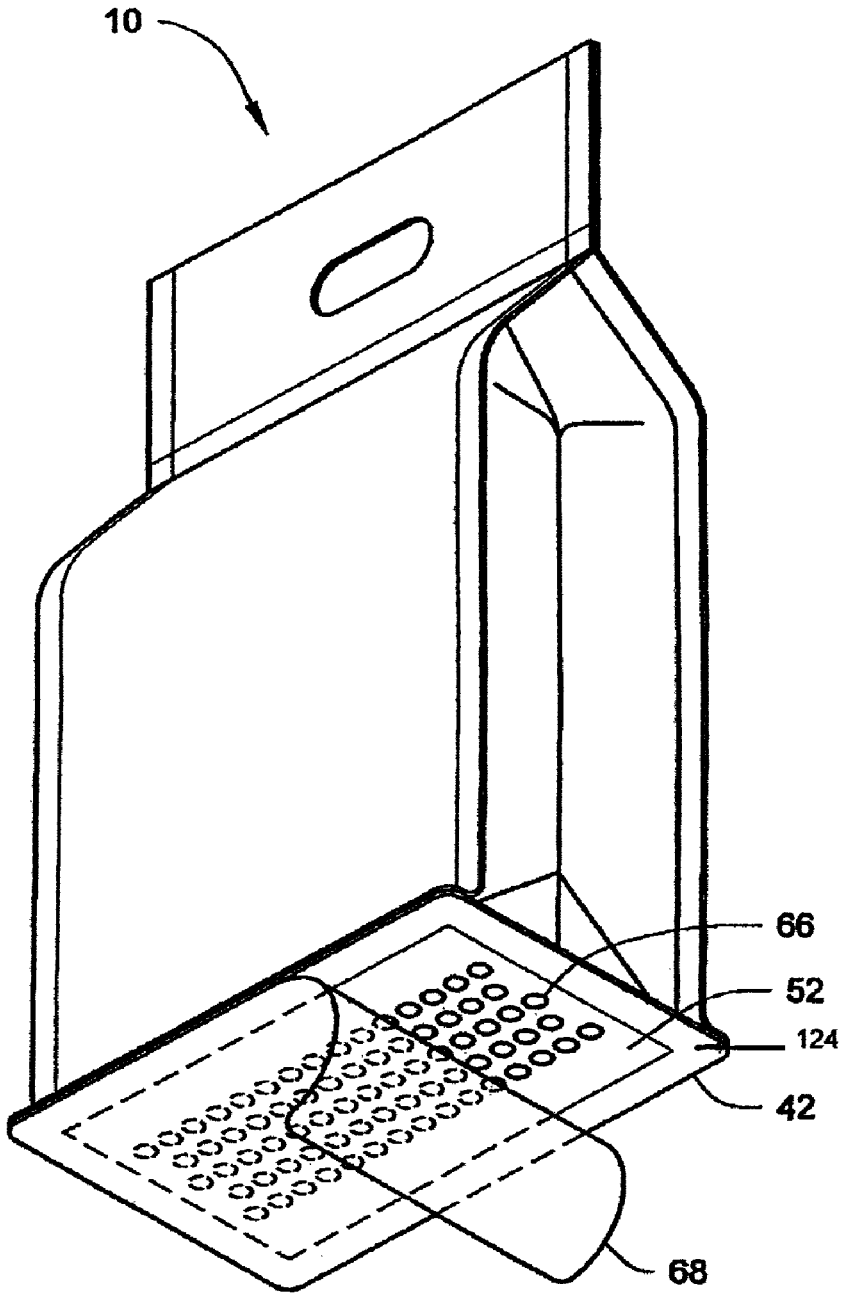
FIG. 3 is a perspective view of the bottom of an embodiment of a bag showing the removable panel layer partially removed.
Figure 4:
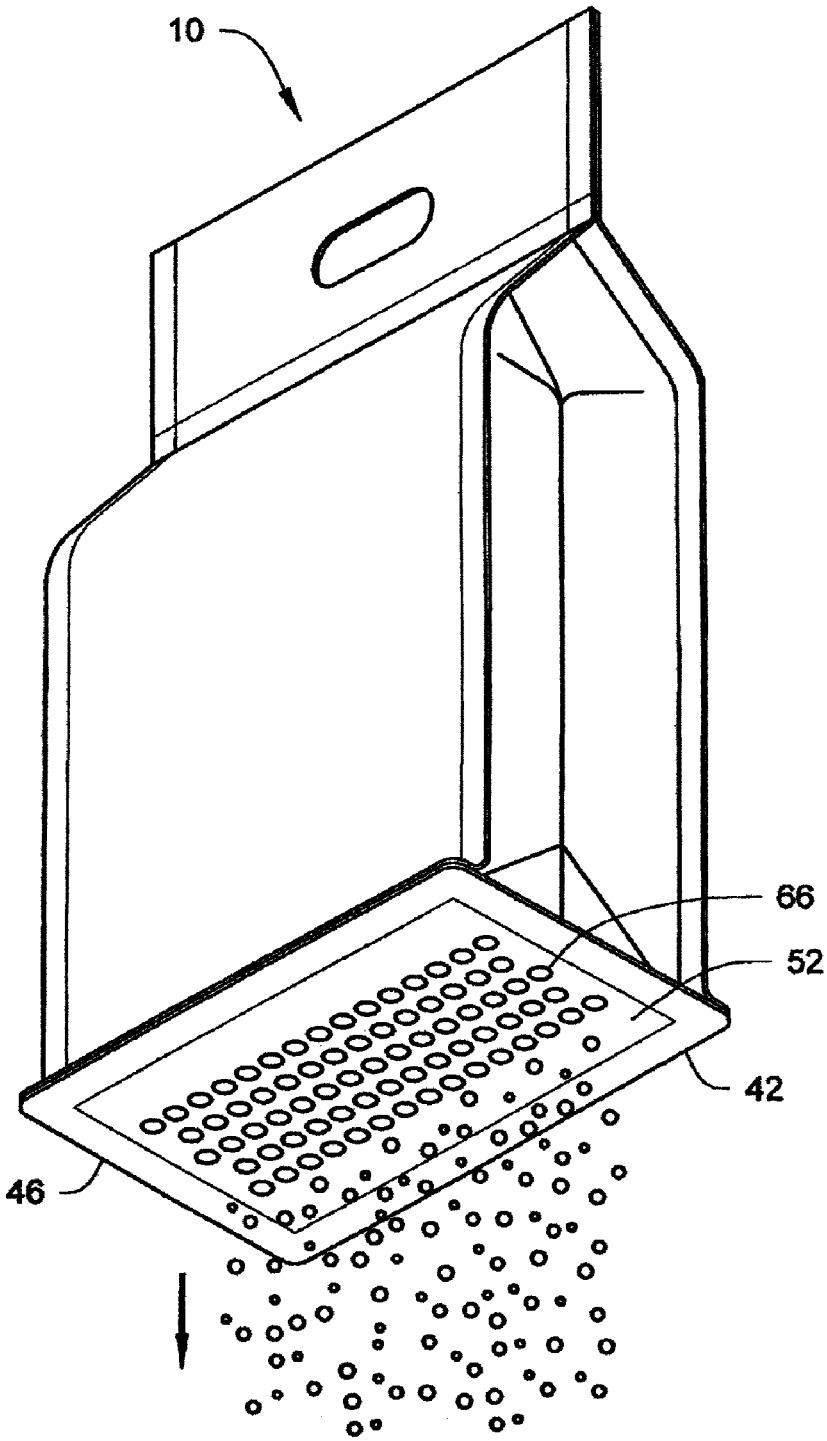
FIG. 4 is a perspective view towards the bottom of an embodiment of a bag with the removable panel layer removed and dispersible material being dispersed.

Bottom gusset panel section 22 may be perforated, as illustrated by distribution apertures 66, as shown particularly in FIGS. 3 and 4. Apertures 66 are appropriately sized, and there is a selected number of apertures per unit area in order to provide desirable passage of dispersible material 12. An aperture 66 is shown to be circular, but other shapes are also possible. The sizes and shapes of the apertures are preferably sized for the type and characteristics of the dispersible material 12 which will be filled in bags 10 and appropriately dispersed.

In an embodiment, removable panel layer 68 is affixed to outer surface 52 of bottom gusset panel section 22. Panel layer 68 covers apertures 66 and prevents leakage of dispersible material 12 from bag 10 before it is desired to disperse material 12.

In an embodiment, a releasable adhesive having a width of about 0.375 inches is applied as appropriate to the outer surface 52 of bottom gusset panel section 22 and panel layer 68 is affixed thereto during the manufacture of bag construction 10. Alternatively, the adhesive may be applied to panel layer 68.

Figure 9:
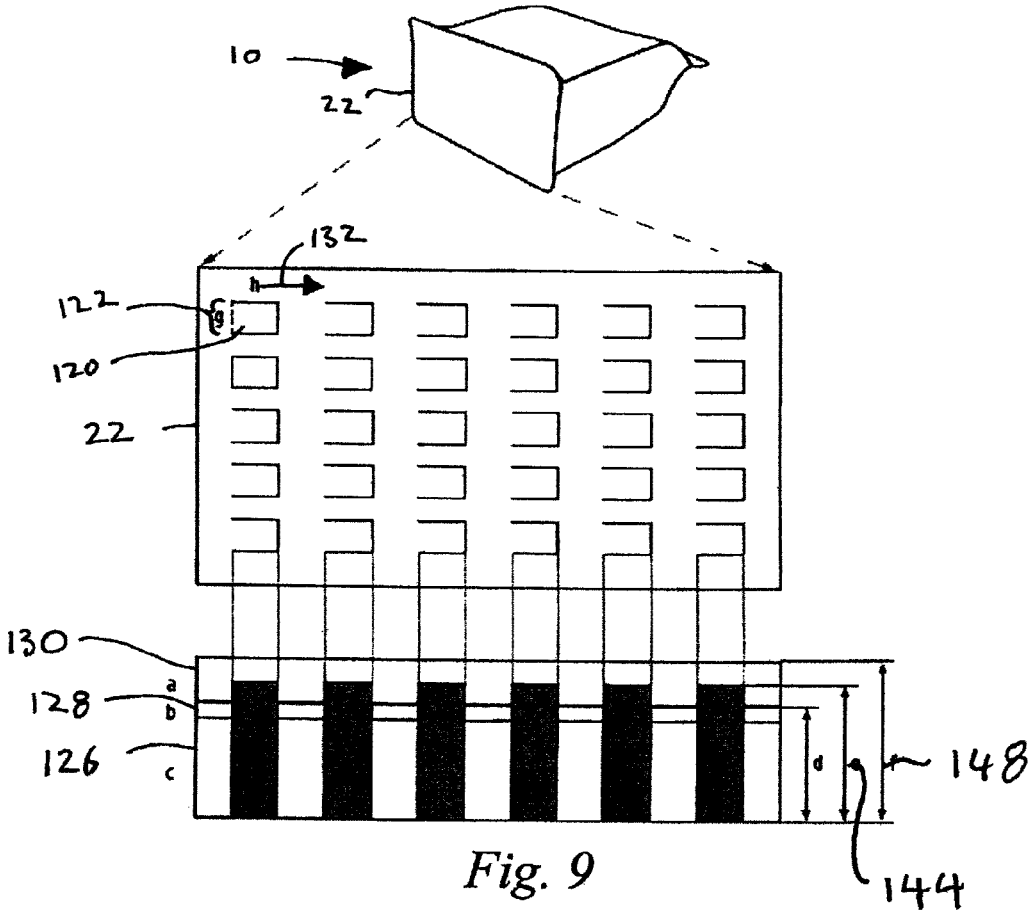
FIG. 9 is a view of an embodiment of a bottom gusset panel layer section including a cutaway view showing layers thereof.
Figure 10:
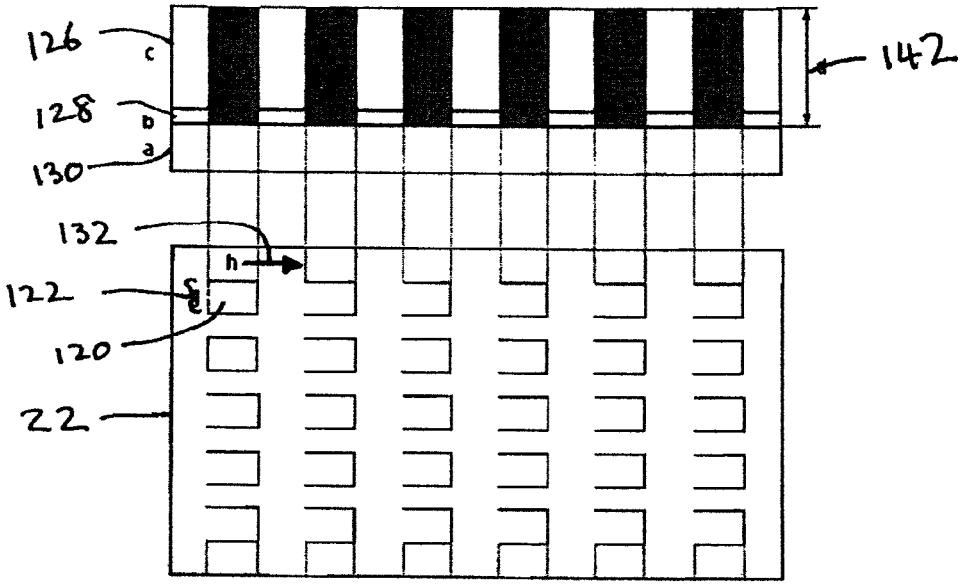
FIG. 10 is a view of an embodiment of a bottom gusset panel layer section including a cutaway view showing layers thereof.
Figure 11:
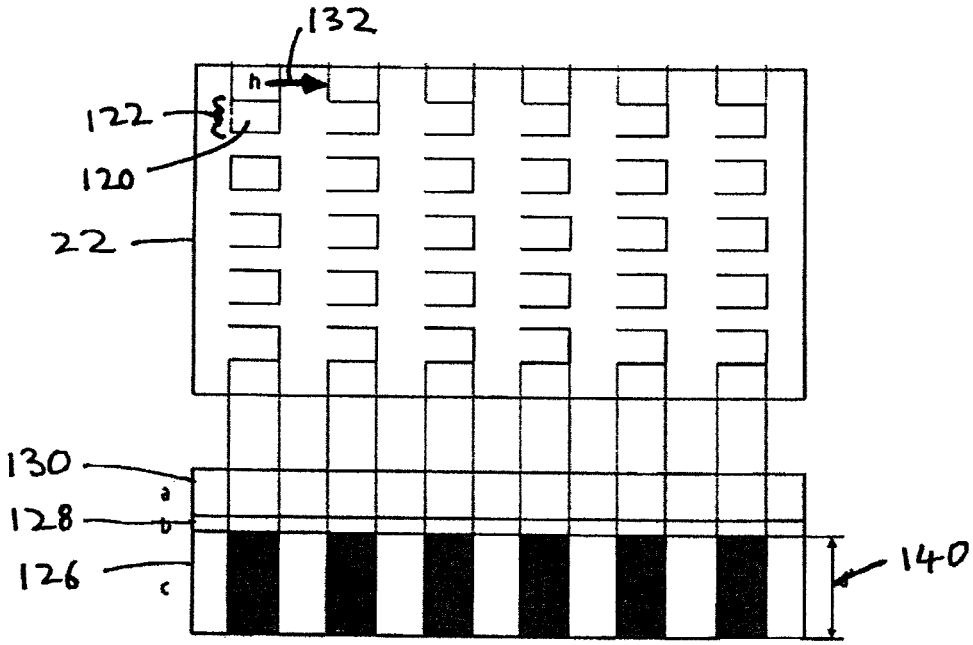
FIG. 11 is a view of an embodiment of a bottom gusset panel layer section including a cutaway view showing layers thereof.

In another embodiment, bottom gusset panel section 22 may have one or more distribution apertures, wherein the distribution aperture is a flap 120, as shown in FIGS. 9, 10, and 11. Each flap 120 includes a fixed portion 122 fixed to the bottom gusset panel section 22. Each flap 122 includes a portion that penetrates through at least one layer making up the bottom gusset panel section 22.

In an embodiment, a bag construction comprises a peel off layer 124 provided between the bottom gusset panel section 22 and the layer that is removable. The peel off layer 124 is penetrated through by the distribution aperture or flap 120. In FIGS. 9, 10, and 11, the layers are shown as first layer 126, second layer 128, and third layer 130. The third layer 130 is similar to the removable panel layer 68 in that the third layer 130 is peeled off when the bag 10 is being used to distribute dispersable material 12.

In an embodiment, the removable panel layer 68 is configured to be removed from the bottom gusset panel section 22 in a peeling direction 132 away from the fixed portion 122.

In an embodiment, the removable panel layer 68 is configured to be removed from said peel off layer 128 in a peeling direction 132 away from the fixed portion 122. The peeling direction 132 away from the fixed portion 122 of the flap 120 is shown in FIGS. 9, 10, and 11 with an arrow. Any direction that includes a vector in the direction of the arrow is defined to be the peeling direction 132 away from the fixed portion 122 of the flap 120.

Figure 5:
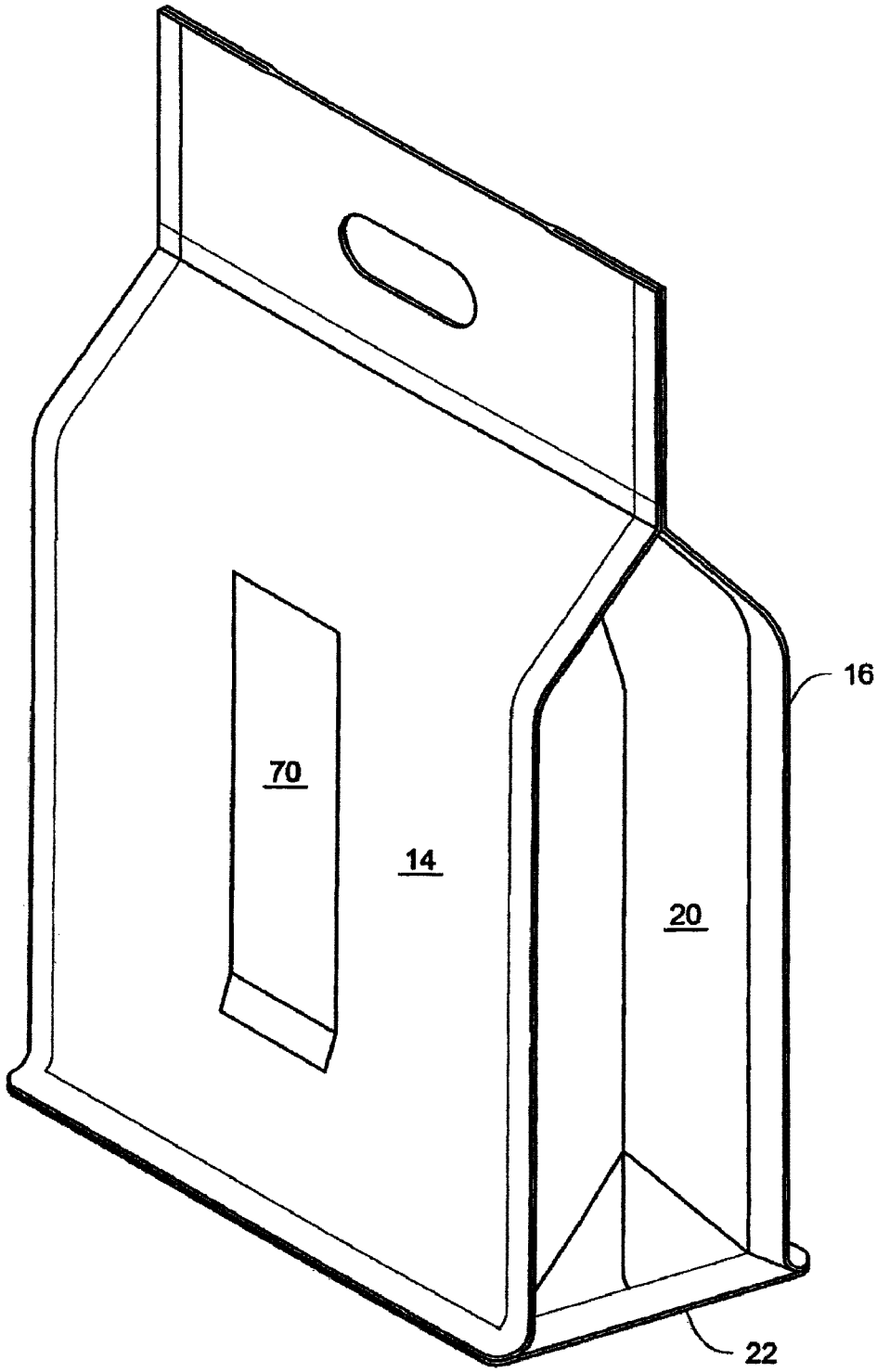
FIG. 5 is a perspective view showing an embodiment of a bag construction with tape section.
Figure 6:
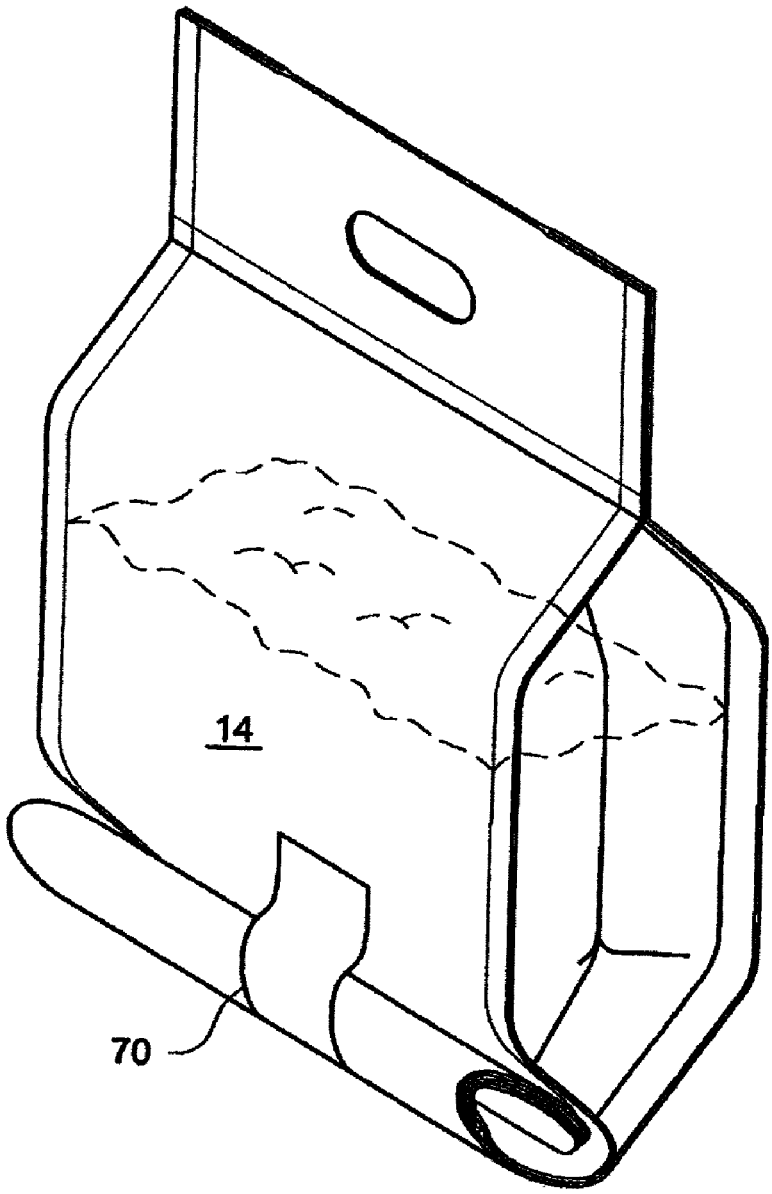
FIG. 6 is a perspective view showing an embodiment of a bag partially emptied of dispersible material with the bottom gusset panel section folded and the tape section used to maintain the folded condition.

In the embodiment of FIGS. 5-6, bag construction 10 further includes a tape section 70 removably fastened to one of first and second panel sections 14,16, one of first and second gusset panel sections 18,20 or bottom gusset panel section 22. In the figures, section 70 is shown removably fastened to first panel section 14.

In another embodiment, a bag construction 10 for dispersing dispersible material 12 comprises a bottom gusset panel section 22 including a first bottom layer 126, a second bottom layer 128, and a third bottom layer 130, said first bottom layer 126 is provided towards said inner surface, said third bottom layer 130 is provided towards said outer surface, and said second bottom layer 128 is provided between said first bottom layer 126 and said third bottom layer 130. The embodiment further includes a plurality of distribution apertures provided on said first bottom layer 126, penetrating through said first bottom layer 126, at least one distribution aperture being a flap 120 that has a fixed portion 122 fixed to said first bottom layer 126. The third bottom layer 130 is removable from said second bottom layer 128, wherein when said third bottom layer 130 is fastened in place, said flap is covered closed to prevent dispersing said dispersible material 12.

In an embodiment, the third bottom layer 130 is configured to be removed from said second bottom layer 128 in a peeling direction away from said fixed portion.

In another embodiment, the peel off layer includes the third bottom layer 130 and the second bottom layer 128, such that when the peel off layer is removed, the separation occurs between the first bottom layer 126 and the second bottom layer 128.

In an embodiment, the plurality of distribution apertures 132 penetrates only the first bottom layer 126, as shown in FIG. 11. Accordingly, aperture depth 140 is equal to the thickness of the first bottom layer 126. In another embodiment, the plurality of distribution apertures 134 penetrates through said first bottom layer 126 and at least partly into the second bottom layer 128. Accordingly, aperture depth 142 is greater than the thickness of the first bottom layer 126. In another embodiment, the plurality of distribution apertures 134 penetrates through said first and second bottom layers 126,128, as shown in FIG. 10. Accordingly, aperture depth 142 is equal to the combined thickness of the first and second bottom layers 126,128. In another embodiment, the plurality of distribution apertures 136 penetrates through said first and second bottom layers 126,128, and also partially into but not through the third bottom layer 130, as shown in FIG. 9. Accordingly, aperture depth 144 is greater than the combined thickness of the first and second bottom layers 126,128, but less than the combined thickness 148 of the first, second, and the third bottom layers 126,128,130.

In an embodiment, the second bottom layer 126 is a peel off layer, wherein the peel off layer is configured to adhere permanently in one surface direction towards one layer, and to adhere removably in a second surface direction towards another layer. For example, in FIG. 9, the peel off layer 128 is permanently adhered to the first bottom layer 126, and removably adhered to the third bottom layer 130. For example, in FIG. 11, the peel off layer 128 is permanently adhered to the third bottom layer 130, and removably adhered to the first bottom layer 126.

In an embodiment, the third bottom layer 130 includes a color marking configured such that at least a portion of said color marking transfers to said second bottom layer 126, and visually marks said second bottom layer 126 with said color marking when said third bottom layer 130 is removed for the first time.

In an embodiment, the second bottom layer 128 includes a color marking, configured such that at least a portion of said color marking transfers to said third bottom layer 130, and visually marking said third bottom layer 130 with said color marking when said third bottom layer 130 is removed for the first time.

The above embodiments allow for a quick visual inspection to determine whether the bag has been already opened. This visual marking would help in determining whether the contents of the bag 10 have been potentially tempered with.

Pouch arrangements according to the present description may be provided with a variety of outer dimensions, depending on the intended use.

Pouch arrangements according to the present description may be manufactured from a variety of materials. It is particularly advantageous, however, that they be constructed from relatively thin, strong material such as polyester biaxially oriented nylon linear low density polyethylene (PET/BON/LLDPE) film. Preferred embodiments which are particularly useful, and which include advantages according to the present description, may be constructed wherein the first and second panel sections 14,16 and the first and second gusset panel sections 18,20 comprise first and second sheets of PET/BON/LLDPE 3-ply, each having a thickness within a range of about 7 mils. Similar material may be utilized for the base gusset (with appropriate apertures or slits therein). Preferably heat sealable film is utilized, so that the means for securing the various panel sections to each another, and securing the bottom gusset section in place, is by heat seals without the need for additional adhesive.

The film materials are available in 3 substrates and are laminated together in a conventional adhesive lamination process. The polyester substrate has an adhesive applied, then the nylon substrate is applied. The polyester substrate and nylon substrate are laminated together. This resulting layer is coated with the linear low density polyethylene substrate, and then laminated together.

The first substrate, polyester, is available from DuPont. The second substrate, biaxially oriented nylon, is available from Allied Signal. The third substrate, linear low density polyethylene, is available from Consolidated Thermoplastics of Chippewa Falls, Wis.

Figure 2:
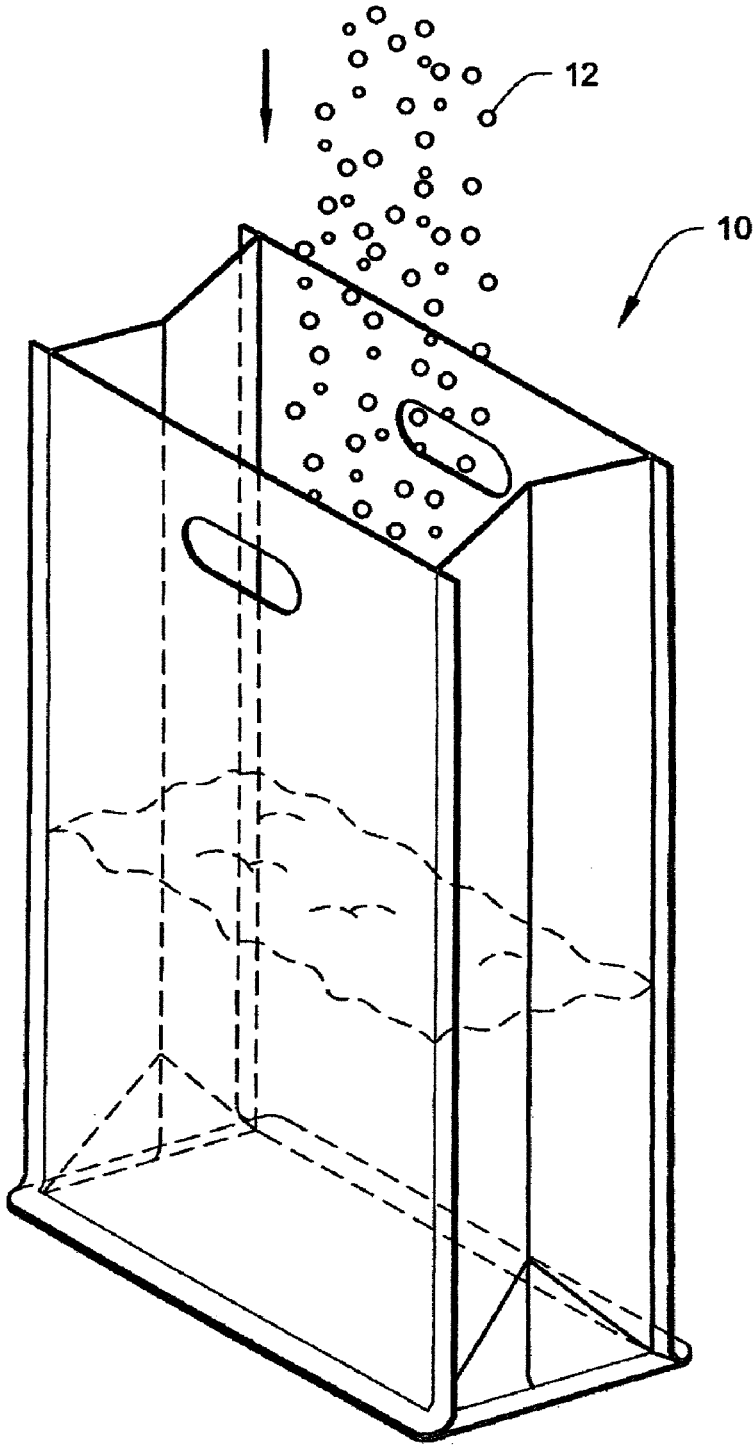
FIG. 2 is a perspective view of the top of an embodiment of a bag construction with the top open and the bag being filled with dispersible material.

In use, the top of bag 10 is open and dispersible material 12 is directed into the bag as shown in FIG. 2. First and second gusset panel sections 18,20 are then folded near the top and first and second panel sections 14,16 are brought together and the appropriate heat sealing as described previously, is done to create flop 54 as shown in FIG. 1. As appropriate, advertising or promotional material can be applied or associated with the bag, the bag is then displayed, and in due time the bag is sold to a consumer.

When dispersion of dispersible material 12 is desired, removable panel 68 is removed. Bag 10 is held by the handle aperture 56 and the bag is appropriately moved over the area where dispersion is desired.

When sufficient dispersion has been applied, the bag is tipped upside down and bottom gusset panel section 22 is folded or rolled from one of its edges toward an opposite of its edges so that all apertures are covered. Tape section 70 is removed from first panel section 14. Tape section 70 is then fastened to one of first and second panel sections 14,16 and to a portion of either bottom gusset panel section 22 or the other of first and second panel sections 14,16, as shown in FIG. 5.

Figure 7:
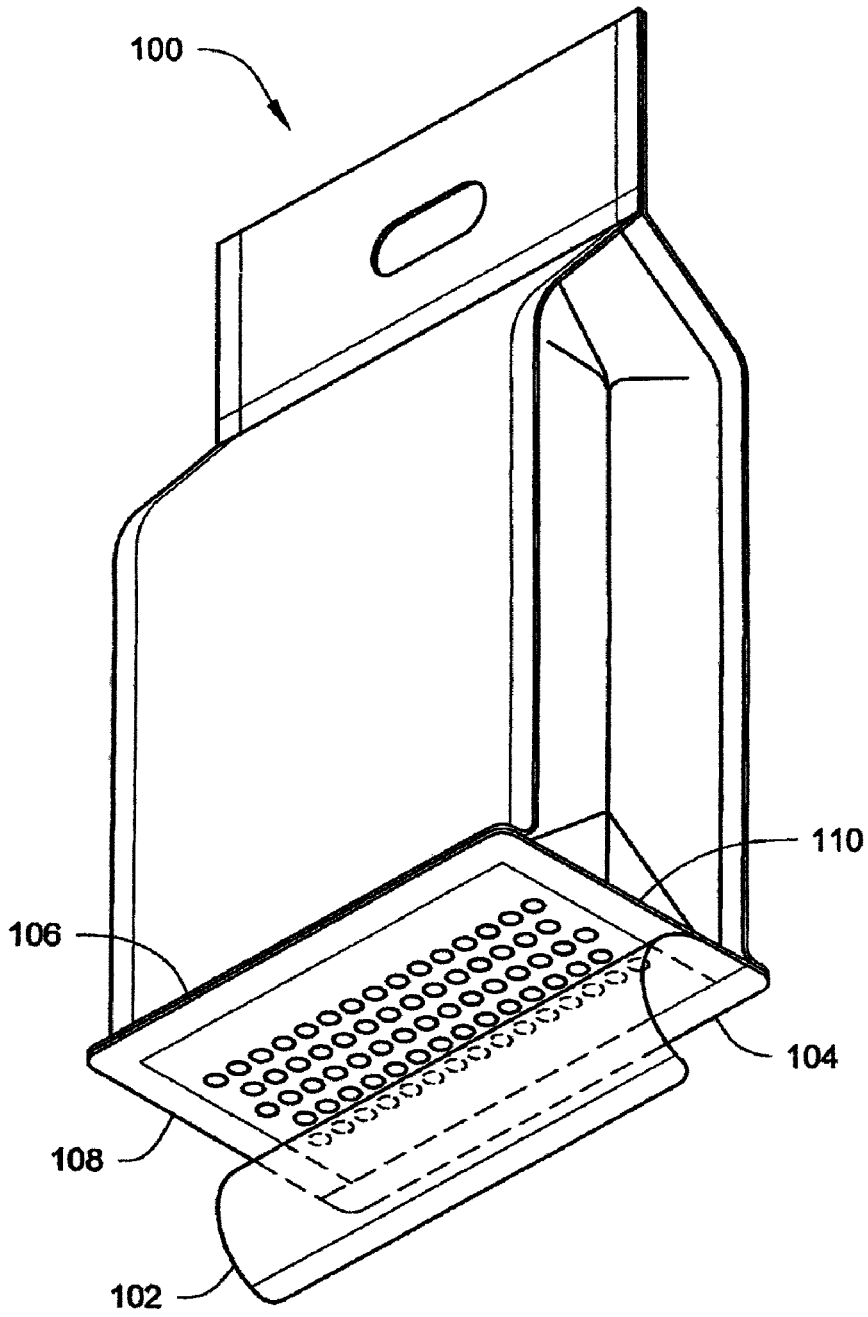
FIG. 7 is a perspective view of the bottom of a bag showing an alternate embodiment of the bag construction with removable panel layer.

A second embodiment is illustrated in FIGS. 6 and 7. Bag construction 100 is essentially the same as bag construction 10, except for removable panel layer 102. Removable panel layer 68, as shown in FIG. 3, is affixed at all four edges with a releasable adhesive so that it can be completely removed before dispersion.

Removable panel layer 102 is affixed at one edge 104 by a heat seal or other permanent attachment. The affixation of the other edges 106,108,110 is by a releasable adhesive.

Figure 8A:
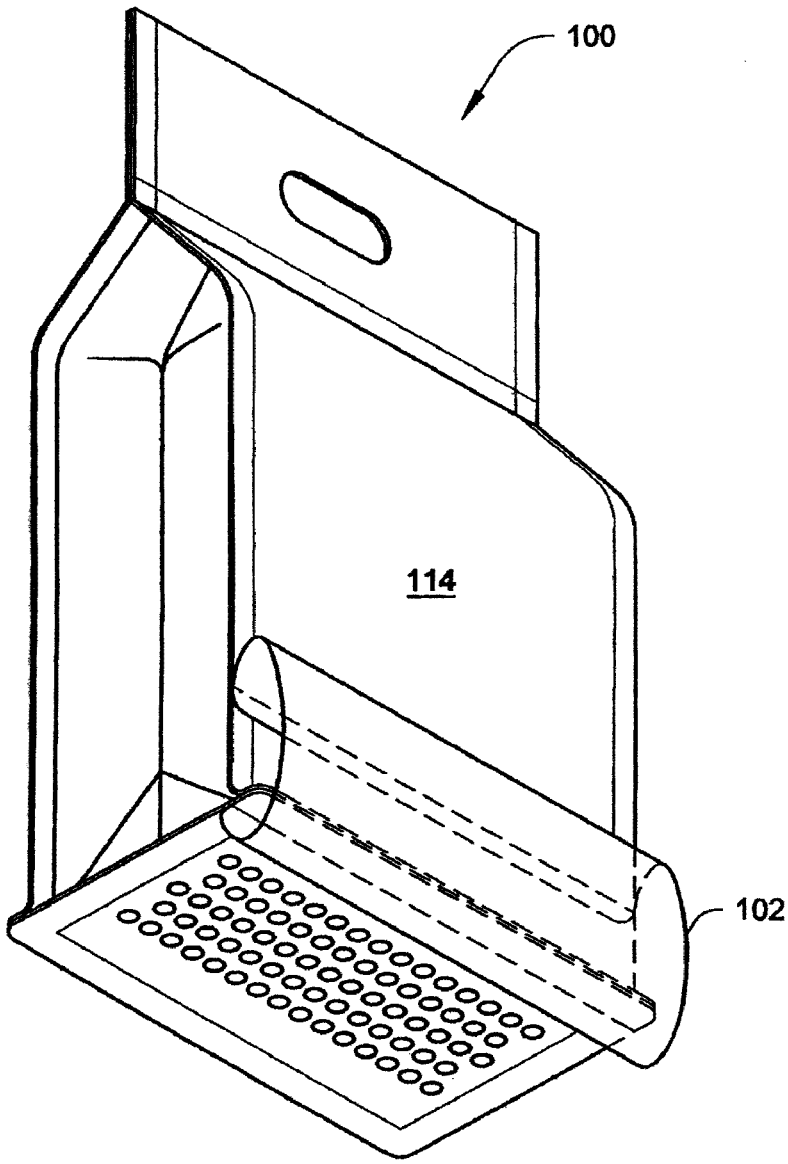
FIG. 8A is a perspective view of the embodiment of FIG. 6 showing the removable panel layer folded back.
Figure 8B:
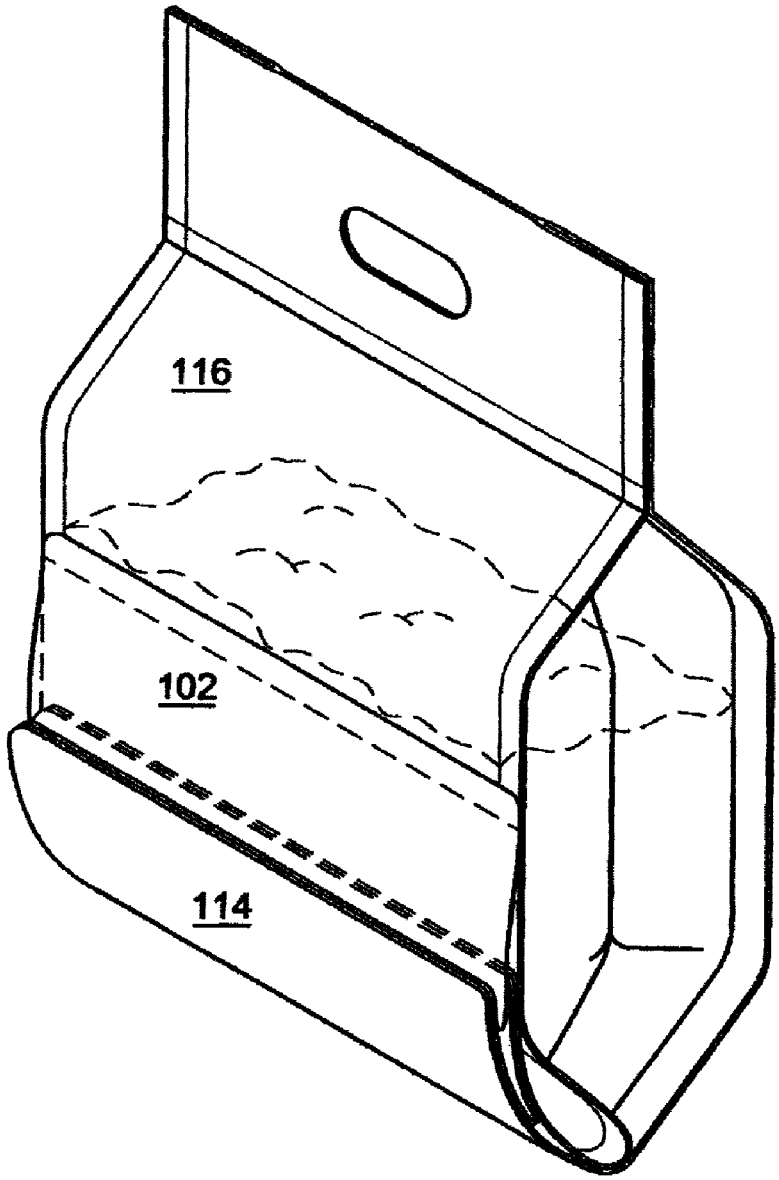
FIG. 8B is a perspective view of the embodiment of FIG. 6 showing the removable panel holding the bottom gusset panel layer section in the folded condition.

In use, when dispersion of dispersible material 12 is desired, panel layer 102 is pulled away from bottom gusset panel section 22 at the edges 106,108,110 held by adhesive and is folded about the heat seal at edge 104. As shown in FIG. 8A, panel layer 102 may be temporarily affixed to, for example, second panel section 114 so that angle panel 102 is out of the way during dispersion of the dispersable material. After some dispersion has been accomplished, but there still remains some dispersible material 12 in bag 100, bottom gusset panel section 22 can be folded and panel layer 102 extended beyond bottom gusset panel section 22 opposite edge 104 panel layer 102 having the heat seal, so that edge 108 can contact and adhere to first panel section 116 as shown in FIG. 8B.

Methodology for manufacturing bag constructions of the general technology type is described and illustrated in U.S. Pat. No. 5,059,036; U.S. Pat. No. 5,147,272; U.S. Pat. No. 5,254,073, all of which are incorporated by reference herein. The methods are modified effectively to provide for application of releasable adhesive and heat sealing affixing the removable panel layer to the bottom gusset panel section and otherwise accommodating the use of the removable panel layer as disclosed herein. It is noted that Totani Giken Kogyo Co., Ltd., of Kyoto, Japan produces machines which can be utilized to manufacture bags in accordance with the present description.

Preferred embodiments have been described. Those skilled in the art will appreciate that various modifications and substitutions are possible, without departing from the scope of the description as claimed and disclosed, including the full scope of equivalents thereof.

What is claimed is:

1. A bag construction for dispersing dispersible material, comprising:

first and second panel sections, each panel section including a bottom panel edge, and two side panel edges;

first and second side gusset panel sections, each side gusset panel section including a bottom side gusset edge, and two side gusset edges, wherein each of said side panel edges are fastened to said side gusset edges one of said side gusset edges of each of said first and second side gusset panel sections;

a bottom gusset panel section with edges, each of said bottom panel edges of said first and second panel sections and said bottom gusset edges of said first and second side gusset panel sections being fastened to a different one of said edges of said bottom gusset panel section to form inner and outer surfaces, said bottom gusset panel section including at least one distribution aperture therein;

a removable panel layer covering said aperture being removably fastened to the outer surface of said bottom gusset panel section wherein when said removable panel layer is fastened in place, said aperture is covered to prevent dispersing the dispersible material, and when said removable panel layer is removed from said bottom gusset panel section, said dispersible material may be dispersed through said aperture; and a peel off layer provided between said bottom gusset panel section and said removable panel layer, said peel off layer being penetrated through by the distribution aperture; said distribution aperture being a flap that has a fixed portion fixed to said bottom gusset panel section; and said removable panel layer is configured to be removed from said peel off layer in a peeling direction away from the fixed portion.

2. The bag construction in accordance with claim 1, including a tape section removably fastened in an original position to one of said first and second panel sections, said first and second said gusset panel sections, and said bottom gusset panel section, wherein when said removable panel layer has been removed and some of said dispersible material has been dispersed, said bottom gusset panel can be folded or rolled from one of said edges to an opposite of said edges and said tape section removed from the original position to fasten one of said first and second panel sections to a portion of either said bottom gusset panel section or the other of said first and second panel sections.

3. The bag construction in accordance with claim 1, wherein said removable panel layer includes a peel off layer provided towards said outer surface of said bottom gusset panel section; said distribution aperture being a flap that has a fixed portion fixed to said bottom gusset panel section; and said removable panel layer is configured to be removed from said peel off layer in a peeling direction away from the fixed portion.

4. A bag construction for dispersing dispersible material, comprising:

first and second panel sections with each having bottom and side panel edges;

first and second side gusset panel sections with each having bottom and side gusset edges, one of said side panel edges of each of said first and second panel sections being fastened to one of said side gusset edges of each of said first and second side gusset panel sections;

a bottom gusset panel section with edges, each of said bottom panel edges of said first and second panel sections and said bottom gusset edges of said first and second side gusset panel sections being fastened to a different one of said edges of said bottom gusset panel section to form inner and outer surfaces, said bottom gusset panel section including at least one distribution aperture therein;

a removable panel layer covering said aperture being removably fastened to the outer surface of said bottom gusset panel section wherein when said removable panel layer is fastened in place, said aperture is covered to prevent dispersing the dispersible material, and when said removable panel layer is removed from said bottom gusset panel section, said dispersible material may be dispersed through said aperture; and a peel off layer provided between said bottom gusset panel section and said removable panel layer, said peel off layer being penetrated through by the distribution aperture; said distribution aperture being a flap that has a fixed portion fixed to said bottom gusset panel section; and said removable panel layer is configured to be removed from said peel off layer in a peeling direction away from the fixed portion, wherein said removable panel layer includes a peel off layer provided towards said outer surface of said bottom gusset panel section; said distribution aperture being a flap that has a fixed portion fixed to said bottom gusset panel section; and said removable panel layer is configured to be removed from said peel off layer in a peeling direction away from the fixed Portion.

5. The bag construction in accordance with claim 4, including means for fastening together one of said first and second panel sections to a portion of either of said bottom gusset panel section or the other of said first and second panel sections, wherein when some of said dispersible material has been dispersed, said bottom gusset panel can be folded or rolled from one of said edges to an opposite of said edges to cover said aperture and said fastening means used to fasten one of said first and second panel sections to a portion of either said bottom gusset panel section or the other of said first and second panel sections.

6. A method for using a bag construction wherein the bag construction allows for dispersing dispersible material, said bag construction including first and second panel sections with each having bottom and side panel edges; first and second side gusset panel sections with each having bottom and side gusset edges, one of said side panel edges of each of said first and second panel sections being fastened to one of said side gusset edges of each of said first and second side gusset panel sections; a bottom gusset panel section with edges, each of said bottom panel edges of said first and second panel sections and said bottom gusset edges of said first and second side gusset panel sections being fastened to a different one of said edges of said bottom gusset panel section to form inner and outer surfaces, said bottom gusset panel section including at least one distribution aperture therein; and a peel off layer provided between said bottom gusset panel section and said removable panel layer, said peel off layer being penetrated through by the distribution aperture; said distribution aperture being a flap that has a fixed portion fixed to said bottom gusset panel section; and said removable panel layer is configured to be removed from said peel off layer in a peeling direction away from the fixed portion, wherein said removable panel layer includes a peel off layer provided towards said outer surface of said bottom gusset panel section; said distribution aperture being a flap that has a fixed portion fixed to said bottom gusset panel section; and said removable panel layer is configured to be removed from said peel off layer in a peeling direction away from the fixed portion, said method comprising: removing said removable panel layer from covering said aperture; and dispersing through said aperture at least some of said dispersible material.

7. The method in accordance with claim 6, wherein said bag construction further includes means for fastening together one of said first and second panel sections to a portion of either of said bottom gusset panel section or the other of said first and second panel sections and wherein said method further includes: following said dispersing step, folding or rolling said bottom gusset panel from one of said edges toward an opposite of said edges to cover said aperture; and fastening with said fastening means one of said first and second panel sections to a portion of either said bottom gusset panel section or the other of said first and second panel sections.

8. A bag construction for dispersing dispersible material, comprising:

first and second panel sections with each having bottom and side panel edges;

first and second side gusset panel sections with each having bottom and side gusset edges, one of said side panel edges of each of said first and second panel sections being fastened to one of said side gusset edges of each of said first and second side gusset panel sections;

a bottom gusset panel section with edges, each of said bottom panel edges of said first and second panel sections and said bottom gusset edges of said first and second side gusset panel sections being fastened to a different one of said edges of said bottom gusset panel section to form inner and outer surfaces;

said bottom gusset panel section including a first bottom layer, a second bottom layer, and a third bottom layer, said first bottom layer is provided towards said inner surface, said third bottom layer is provided towards said outer surface, and said second bottom layer is provided between said first bottom layer and said third bottom layer; and a plurality of distribution apertures provided on said first bottom layer, penetrating through said first bottom layer, at least one distribution aperture being a flap that has a fixed portion fixed to said first bottom layer, said third bottom layer being removable from said second bottom layer, wherein when said third bottom layer is fastened in place, said flap is covered closed to prevent dispersing said dispersible material, and when said third bottom layer is removed from said second bottom layer, said dispersible material may be dispersed through opening of said flap.

9. The bag construction in accordance with claim 8, wherein said third bottom layer is configured to be removed from said second bottom layer in a peeling direction away from said fixed portion.

10. The bag construction in accordance with claim 9, wherein said plurality of distribution apertures penetrating through said second bottom layer.

11. The bag construction in accordance with claim 10, wherein said plurality of distribution apertures penetrating partially into but not all way through said third bottom layer.

12. The bag construction in accordance with claim 8, wherein said third bottom layer includes a color marking, at least a portion of said color marking transfers to said second bottom layer, and marking said second bottom layer with said color marking when said third bottom layer is removed for the first time.

13. The bag construction in accordance with claim 8, wherein said second bottom layer includes a color marking, at least a portion of said color marking transfers to said third bottom layer, and marking said third bottom layer with said color marking when said third bottom layer is removed for the first time.

14. The bag construction in accordance with claim 8, including a tape section removably fastened in an original position to one of said first and second panel sections, said first and second said gusset panel sections, and said bottom gusset panel section, wherein when said third bottom layer has been removed and some of said dispersible material has been dispersed, said third bottom layer can be folded or rolled from one of said edges to an opposite of said edges and said tape section removed from the original position to fasten one of said first and second panel sections to a portion of either said bottom gusset panel section or the other of said first and second panel sections.

* * * * *